US007694370B1

(12) United States Patent
Lee

(10) Patent No.: US 7,694,370 B1
(45) Date of Patent: Apr. 13, 2010

(54) MASSAGE TABLE FOR WOMAN

(76) Inventor: Chun-Hsin Lee, No. 2, Pinghe 12th Street, Changhua (TW)

( * ) Notice: Subject to any disclaimer, the term of this patent is extended or adjusted under 35 U.S.C. 154(b) by 0 days.

(21) Appl. No.: 12/487,672

(22) Filed: Jun. 19, 2009

(30) Foreign Application Priority Data

Nov. 18, 2008 (CN) ..... 97220752 U

(51) Int. Cl.
*A47C 20/02* (2006.01)

(52) U.S. Cl. ..... 5/632; 5/652; 5/652.1; 5/622; 5/638; 5/735

(58) Field of Classification Search ..... 5/63–632, 5/638, 652, 661, 181, 725, 735, 652.1; 108/35, 108/77; 606/242–245
See application file for complete search history.

(56) References Cited

U.S. PATENT DOCUMENTS 2,517,681 A * 8/1950 Koerper ..... 606/242
2,579,783 A * 12/1951 Branto ..... 5/617
4,856,497 A * 8/1989 Westphal ..... 606/242
5,946,749 A * 9/1999 Sewell ..... 5/110
6,081,947 A * 7/2000 Disher ..... 5/632
6,408,465 B1 * 6/2002 Fleming ..... 5/620
6,684,426 B1 * 2/2004 Lin et al. ..... 5/620
6,934,988 B1 * 8/2005 Wetzler et al. ..... 5/621
6,938,287 B1 * 9/2005 Mahshie ..... 5/111
2006/0112490 A1 * 6/2006 Chausse ..... 5/690

* cited by examiner

*Primary Examiner*—Michael Trettel

(57) ABSTRACT

A massage table apparatus for woman includes a first hole for accommodating the face contour of a woman and a second hole for accommodating the breasts contour thereof when the woman is lying on the massage table on a face down position so as to bring a degree of comfort to the woman engaging in leisure activities including massage.

4 Claims, 9 Drawing Sheets

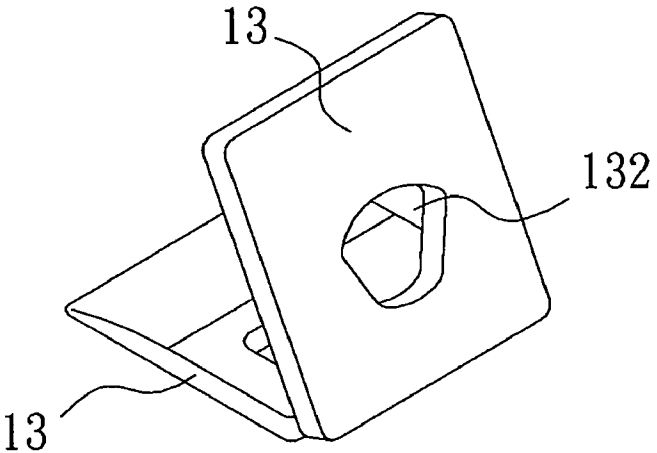
FIG. 5-B
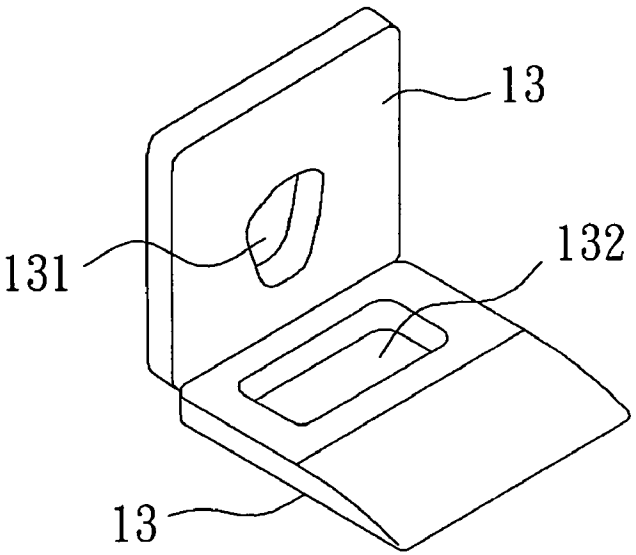
FIG. 5-A

MASSAGE TABLE FOR WOMAN

BACKGROUND OF THE INVENTION

1. Field of Invention

The invention relates to massage tables and more particularly to a massage table apparatus comprising a first hole for accommodating the face contour of a woman and a second hole for accommodating the breasts contour thereof when the woman is lying on the massage table on a face down position so as to bring a degree of comfort to the woman engaging in leisure activities including massage.

2. Description of Related Art

A conventional type of massage table is flat. One drawback has been found in it. In detail, there is no hole for accommodating the face contour of a person lying thereon. It is thus typical for the person to turn his (or her) head with the cheek lying on the table in order to comfortably lie thereon. However, this lying position is not comfortable especially if the person lying on the table engages in massage for a relatively long period of time.

Another conventional type of massage table having a hole for accommodating the face contour of a person is commercially available. It is advantageous since a person lying on the massage table may have his or her head disposed on the hole in a comfortable manner.

However, such type of massage table does not take the breasts of a woman into consideration. Hence, a woman lying on the massage table may still feel uncomfortable even her facing down face is supported by the edge of the hole because unfortunately the surface of the table uncomfortably compresses her breasts.

There have been numerous suggestions in prior patents for massage table. For example, U.S. Pat. No. 7,475,439 discloses a massage table with attachments designed for use by a couple in an intimate setting for the mutual satisfaction of both persons engaged in the massage. Thus, continuing improvements in the exploitation of massage table are constantly being sought.

SUMMARY OF THE INVENTION

It is therefore one object of the invention to provide a massage table apparatus comprising a first hole for accommodating the face contour of a woman and a second hole for accommodating the breasts contour thereof when the woman is lying on the massage table on a face down position so as to bring a degree of comfort to the woman engaging in leisure activities including massage.

The above and other objects, features and advantages of the invention will become apparent from the following detailed description taken with the accompanying drawings.

BRIEF DESCRIPTION OF THE DRAWINGS

FIGS. 5-A and 5-B are perspective views of the padding viewed from different angles with one portion thereof pivoting in different angles respectively;

DETAILED DESCRIPTION OF THE INVENTION

Figure 1:
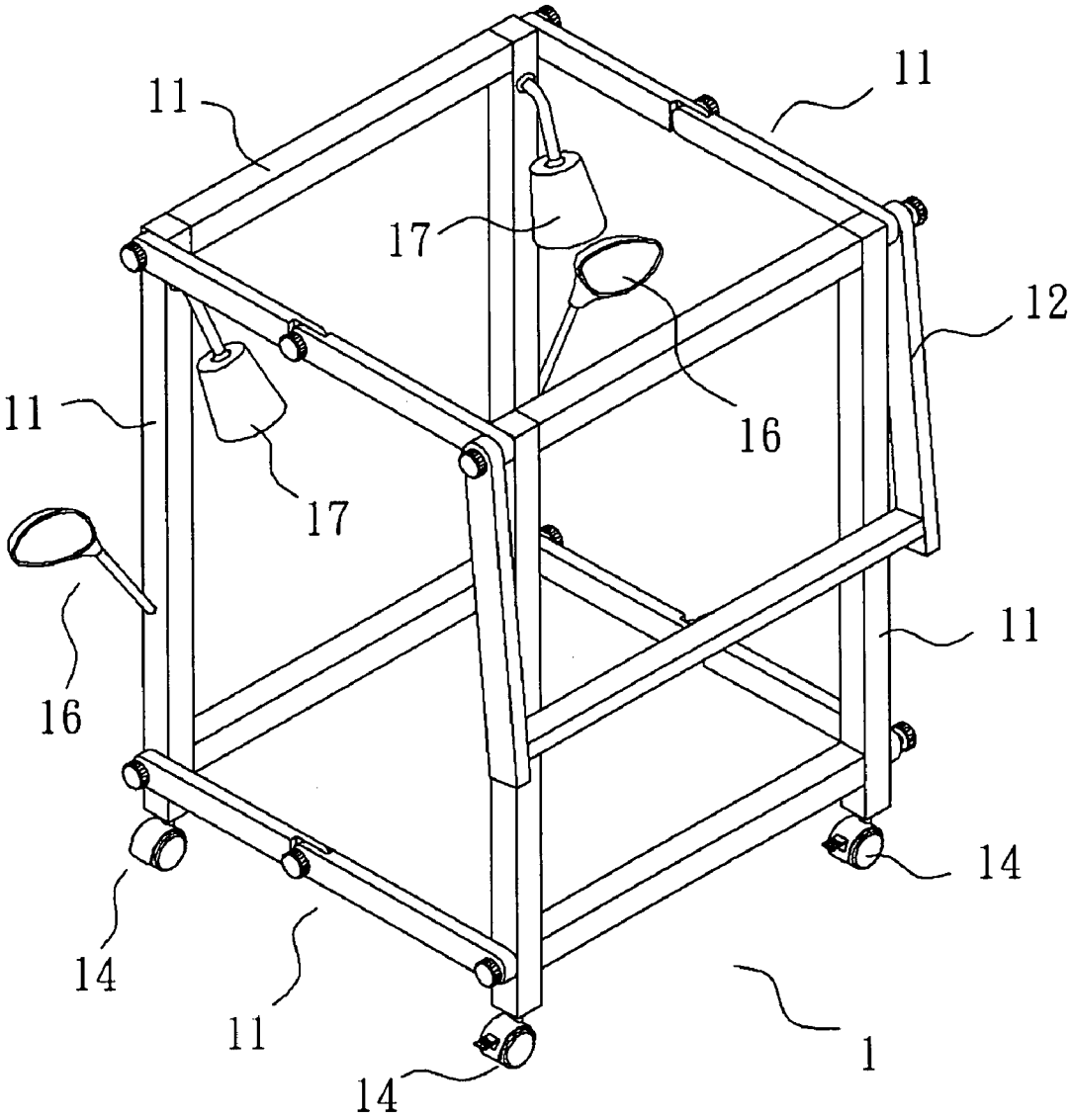
FIG. 1 is a perspective view of a cart of a massage table according to a first preferred embodiment of the invention.
Figure 2:
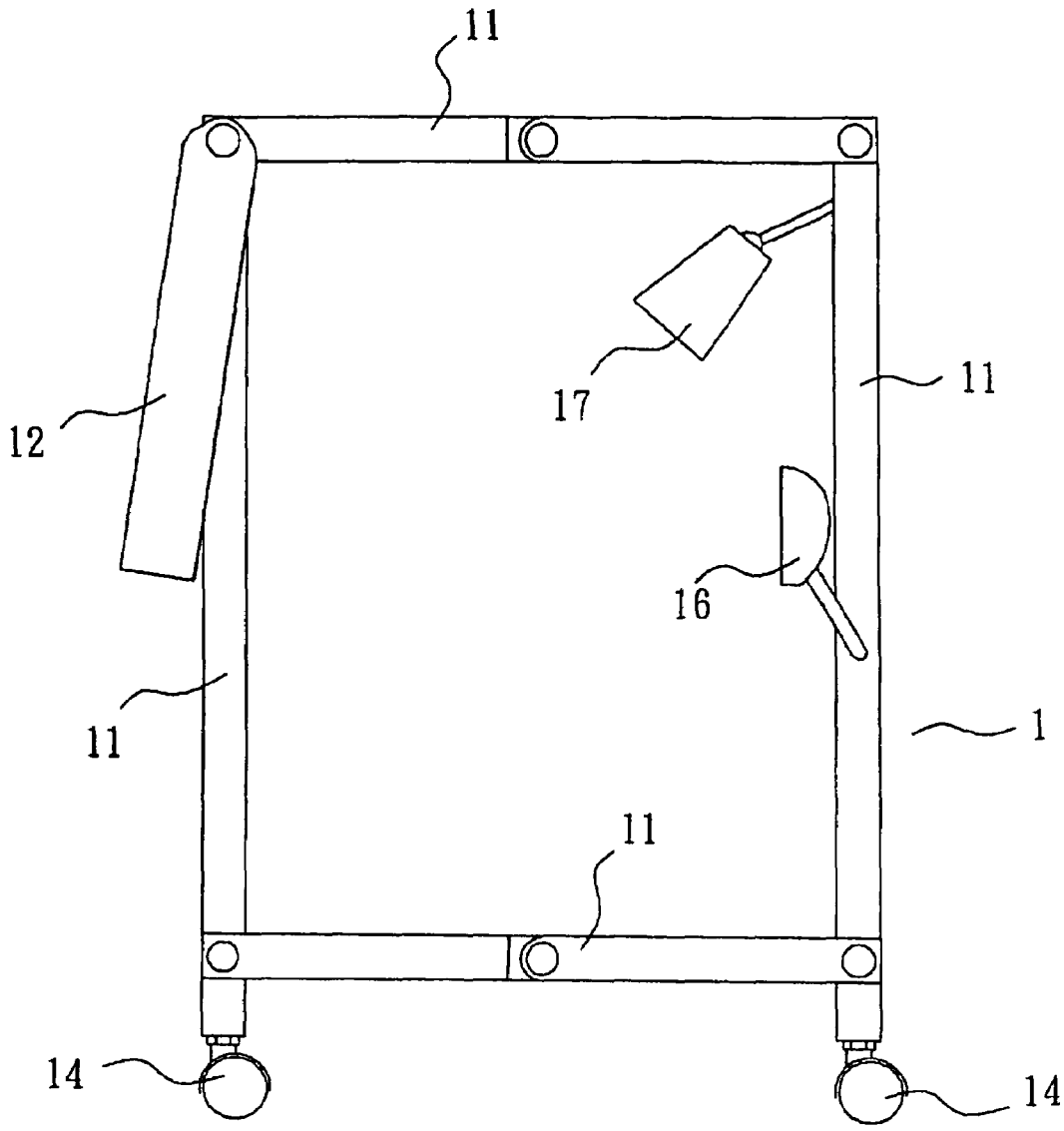
FIG. 2 is a side elevation of the cart.
Figure 3:
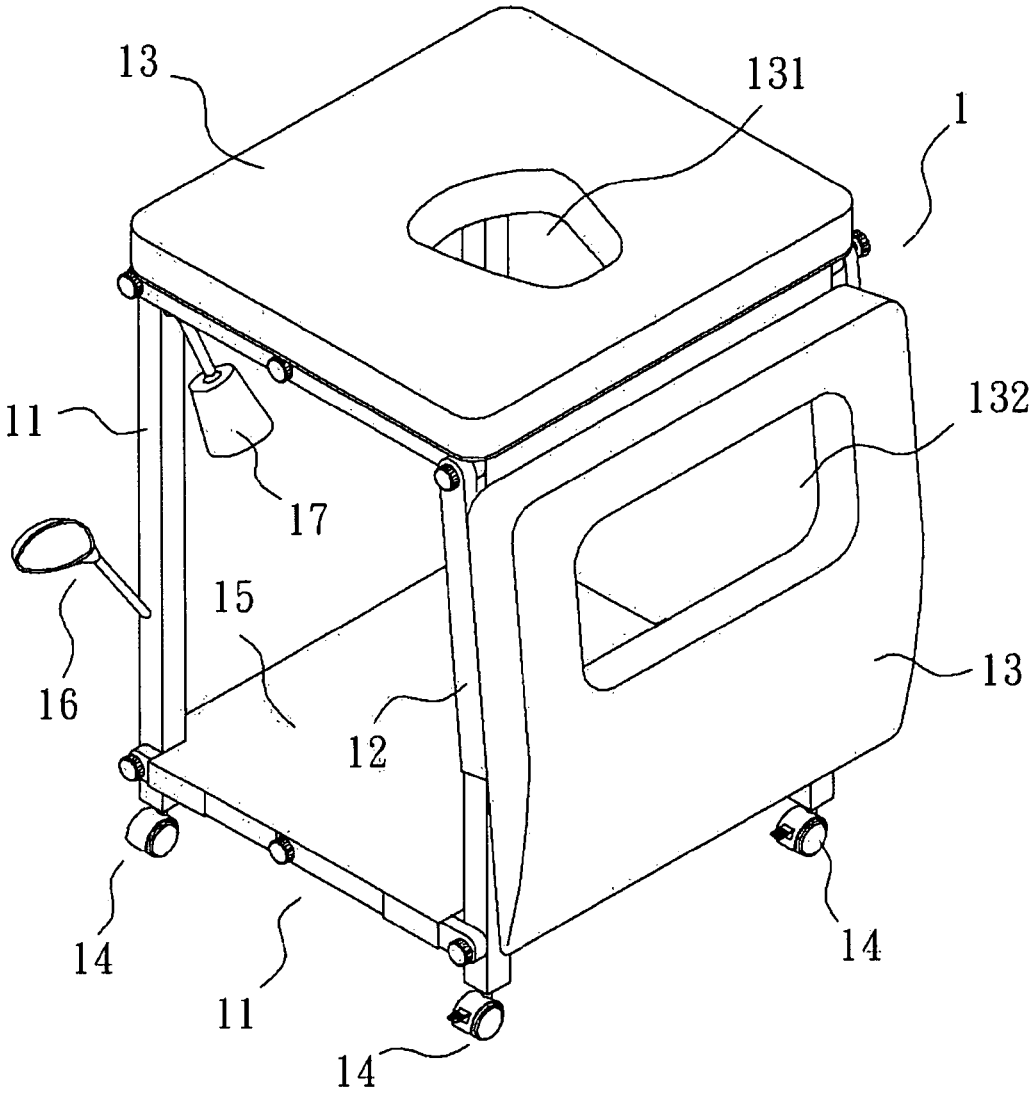
FIG. 3 is a view similar to FIG. 1 with a portion of a hinged padding being mounted thereon.
Figure 4:
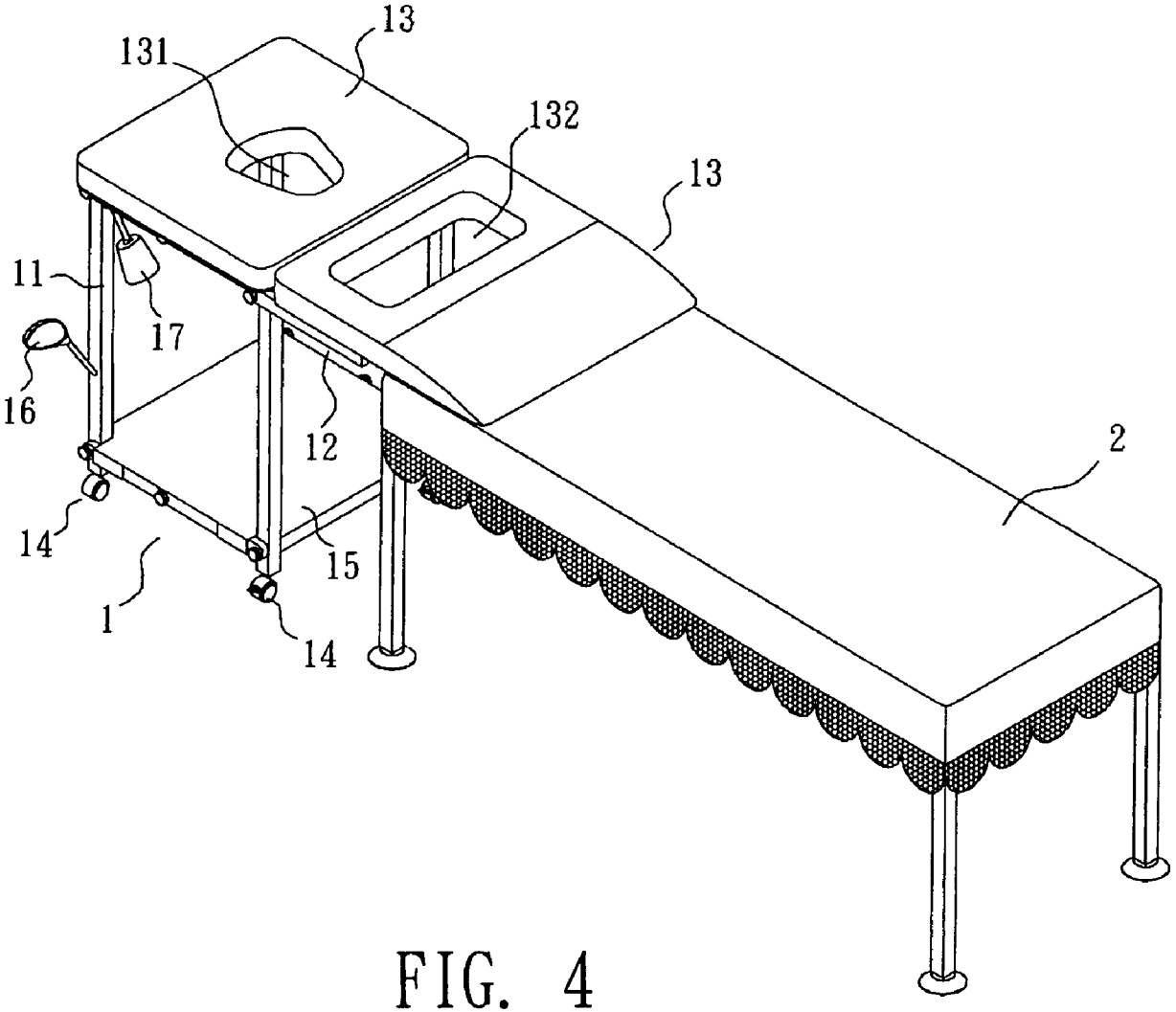
FIG. 4 is a perspective view of the massage table in a ready to use position.

Referring to FIGS. 1 to 5-B and 7 to 9, a massage table in accordance with a first preferred embodiment of the invention comprises the following components as discussed in detail below.

A folding cart 1 comprises a plurality of frame members 11 assembled as a three-dimensional structure having six parallelograms, four wheels 14 on four bottom corners of the three-dimensional structure respectively, a U-shaped member 12 pivotably mounted on both ends of a top rear one of the frame members 11, and a hinged two-piece padding 13. Either portion of the padding 13 is a rectangle in which one portion comprises a first hole 131 shaped in conformity to the face of a woman, and the other portion comprises a rectangular second hole 132 shaped in conformity to the breasts of the woman.

The cart 1 further comprises two mirrors 16 on two front vertical ones of the frame members 11 respectively, and two lights 17 on two top front corners of the three-dimensional structure respectively.

An assembly of the massage table of the first preferred embodiment of the invention will be described in detail below. The U-shaped member 12 is positioned to dispose horizontally (i.e., being flush with the top of the cart 1) by pivoting. Next, put one portion having the first hole 131 on the top of the cart 1 and the other portion having the second hole 132 on the U-shaped member 12 respectively. Next, move an elongated table 2 until a curved section of the other portion of the padding 13 is supported by a front portion of the table 2 (see FIG. 4). Moreover, a board 15 is provided to be adjustably mounted on, for example, a bottom of the three-dimensional structure of the cart 1 (see FIG. 3).

Figure 7:
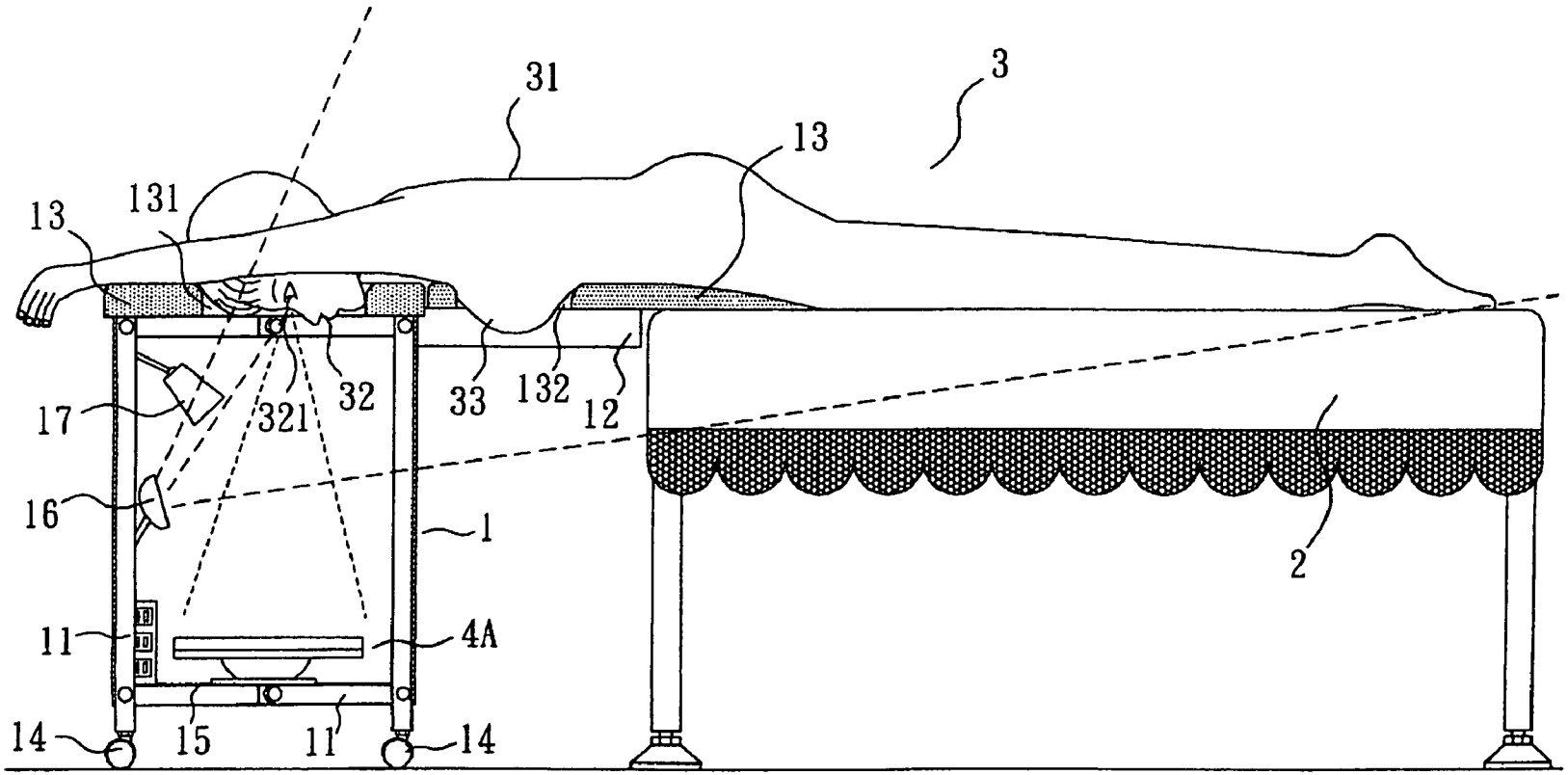
FIG. 7 is a side elevation of the massage table of the first preferred embodiment of the invention with a woman lying on the table with her face downwardly contacting the edge of the first hole and her breasts downwardly contacting the edge of the second hole to engage in a first leisure activity in a comfortable manner.

Thereafter, a woman 3 may lie on the massage table with her back 31 facing up, her face 32 downwardly contacting the edge of the first hole 131, and her breasts 33 downwardly contacting the edge of the second hole 132 (see FIG. 7). Also, a video player (e.g., DVD player) 4A may be mounted on the board 15 with the eyes 321 being directly thereabove. Therefore, the woman 3 may comfortably engage in a first leisure activity including watching video clips played by the DVD player 4A with the light 17 being turned on (see FIG. 7).

Figure 8:
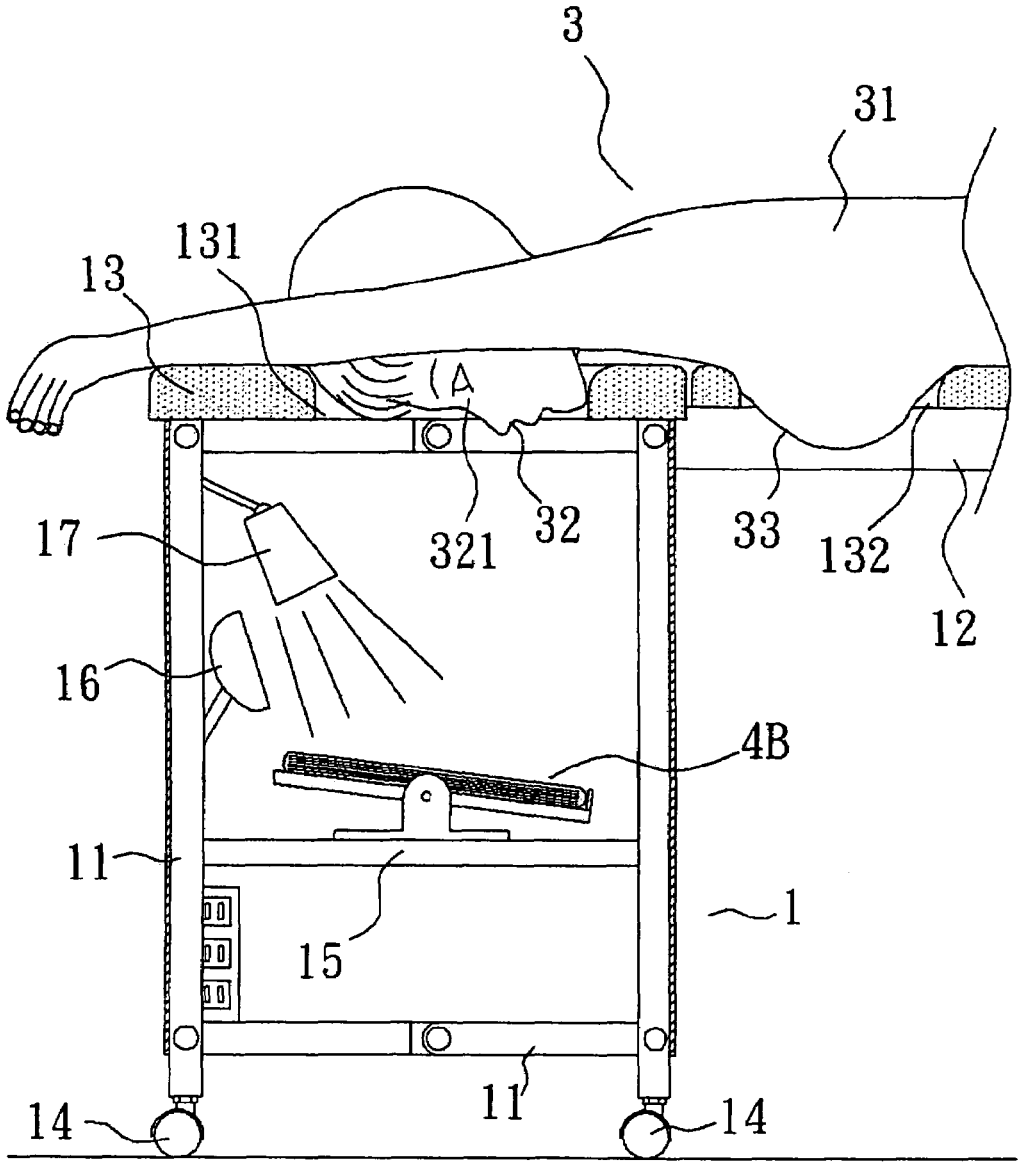
FIGS. 8 and 9 are views of a front portion of FIG. 7 showing the woman engaged in second and third leisure activities in a comfortable manner respectively.

Alternatively, the DVD player 4A is replaced by a stand 4B (see FIG. 8). For example, a book may be placed on the stand 4B which is placed on the upwardly adjusted board 15. Hence, the woman 3 may clearly read the book.

Figure 9:
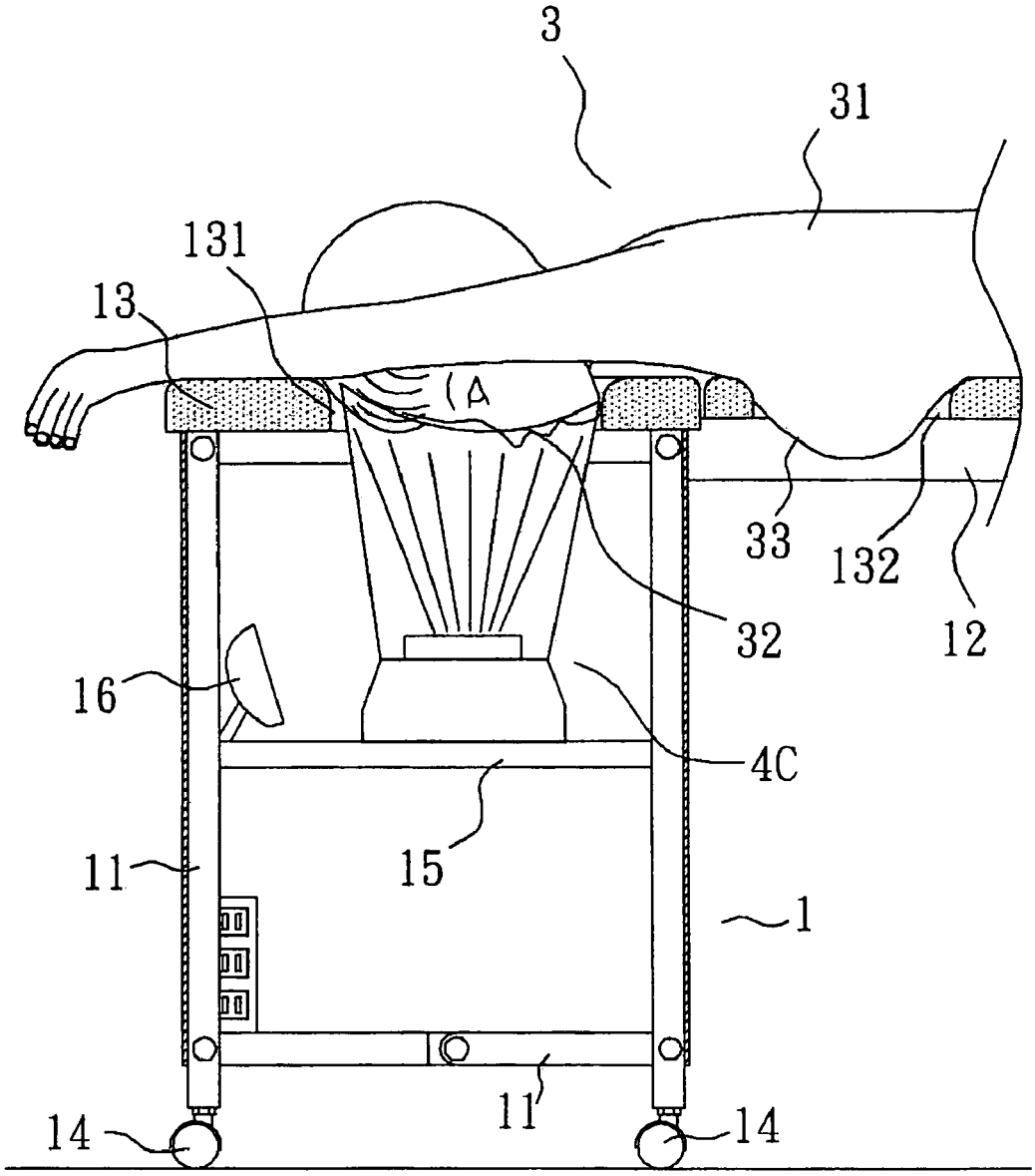

Still alternatively, the stand 4B is replaced by a therapeutic device 4C which is placed on the further upwardly adjusted board 15 (see FIG. 9). Hence, a therapeutic treatment to the face 32 can be performed by the therapeutic device 4C.

Figure 6:
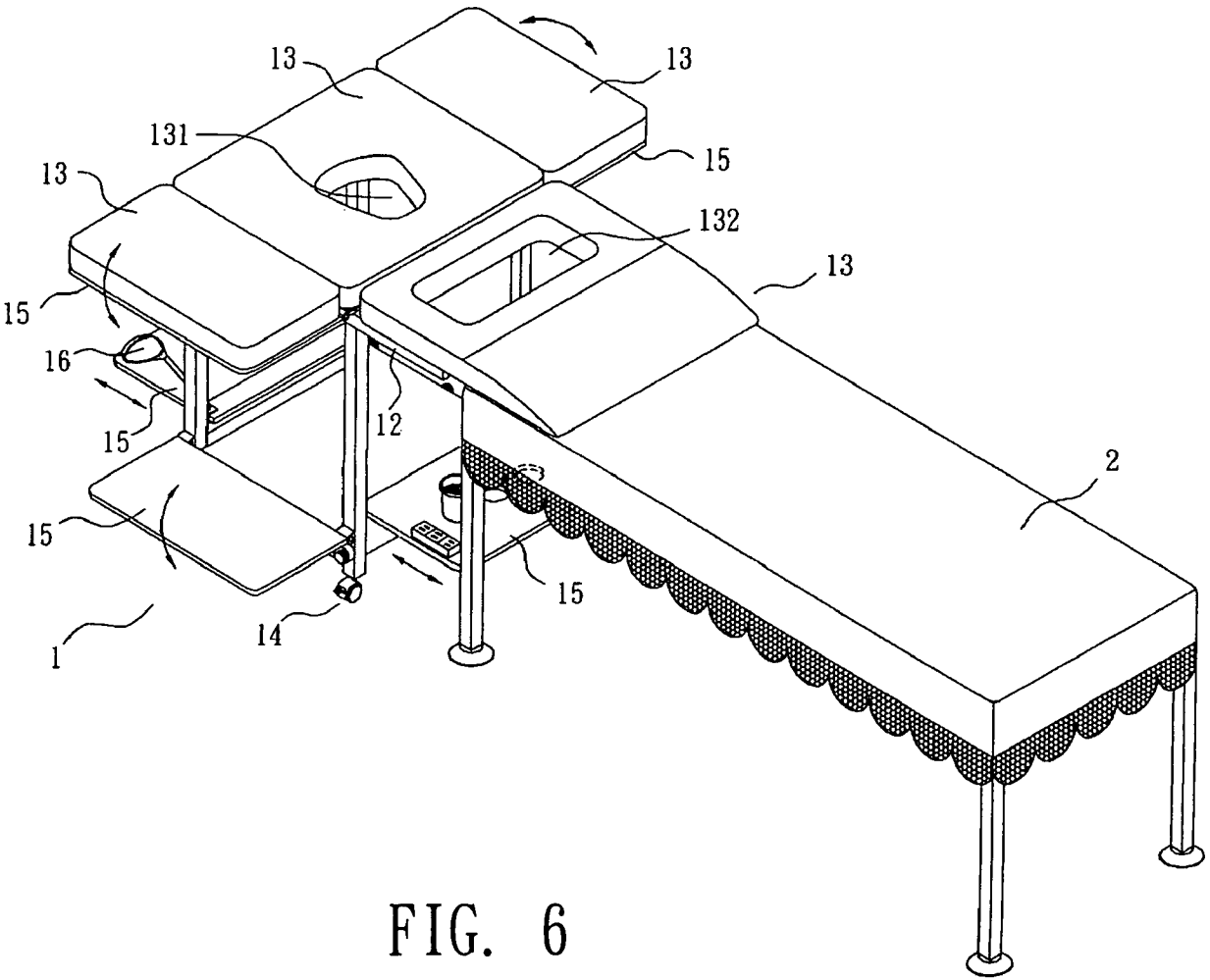
FIG. 6 is a perspective view of a massage table according to a second preferred embodiment of the invention in a ready to use position.

Referring to FIG. 6, a massage table in accordance with a second preferred embodiment of the invention is shown. The characteristics of the second preferred embodiment are detailed below. The upwardly adjustable board 15 is replaced by two additional boards 15 back and forth slidably disposed on front and rear ends of the three-dimensional structure, two further additional boards 15 (only one is shown) hingedly disposed on both sides of a bottom of the three-dimensional structure, and two still further additional boards 15 hingedly disposed on both sides of a top of the three-dimensional structure respectively. Moreover, the padding 13 is a four-piece member and is shaped as a T when it fully extends. Articles may be placed on these boards 15.

While the invention herein disclosed has been described by means of specific embodiments, numerous modifications and variations could be made thereto by those skilled in the art without departing from the scope and spirit of the invention set forth in the claims.

What is claimed is:

1. A massage table apparatus comprising:

a cart comprising a U-shaped member pivotably mounted on both ends of a top rear end;

a two-piece padding comprising a first portion having a first hole, and a second portion hingedly connected to the first portion, the second portion having a second hole; and a table, wherein in a ready to use position the U-shaped member is flush with a top of the cart, the first portion of the padding is disposed on the top of the cart, the second portion of the padding is disposed on the U-shaped member, and a section behind the second hole of the second portion of the padding is rested upon a front portion of the table so that a woman may lie on the padding and the table with her face downwardly rested upon the first hole, and her breasts downwardly rested upon the second hole.

2. The massage table apparatus of claim 1, further comprising a board vertically adjustably disposed on a bottom of the cart.

3. A massage table apparatus comprising:

a cart comprising a U-shaped member pivotably mounted on both ends of a top rear end;

a first board hingedly connected to one side of a top of the cart;

a second board hingedly connected to the other side of the top of the cart;

a four-piece padding comprising a first portion having a first hole, a second portion hingedly connected to the first portion, the second portion having a second hole, a third portion hingedly connected to one side of the first portion, and a fourth portion hingedly connected to the other side of the first portion; and a table, wherein in a ready to use position the U-shaped member is flush with the top of the cart, the first portion of the padding is disposed on the top of the cart, the second portion of the padding is disposed on the U-shaped member, the third portion of the padding is disposed on the first board, the fourth portion of the padding is disposed on the second board, and a section behind the second hole of the second portion of the padding is rested upon a front portion of the table so that a woman may lie on the padding and the table with her face downwardly rested upon the first hole, and her breasts downwardly rested upon the second hole.

4. The massage table apparatus of claim 3, further comprising a third board horizontally slidably disposed on a front end of the cart, and a fourth board horizontally slidably disposed on a rear end of the cart respectively.

* * * * *